United States Patent [19]

Matsui

[11] Patent Number: 4,791,855

[45] Date of Patent: Dec. 20, 1988

[54] CYLINDER LOCKING DEVICE

[75] Inventor: Akio Matsui, Gifu, Japan

[73] Assignee: Pubot Giken Co., Ltd., Aichi, Japan

[21] Appl. No.: 922,364

[22] Filed: Oct. 23, 1986

Related U.S. Application Data

[63] Continuation-in-part of Ser. No. 710,245, Mar. 11, 1985, abandoned.

[51] Int. Cl.[4] ..... F15B 15/26

[52] U.S. Cl. ..... 92/24; 92/27; 92/28; 188/67

[58] Field of Search ..... 92/15, 23, 24, 25, 27, 92/28; 188/67, 77 W

[56] References Cited

U.S. PATENT DOCUMENTS

| | | | |
|---|---|---|---|
| 43,912 | 8/1864 | Hittinger | 92/23 |
| 2,678,538 | 5/1954 | Cowan | 92/28 |
| 2,889,895 | 6/1959 | Snow | 92/28 |
| 3,096,075 | 7/1963 | Brown | 188/67 |
| 3,194,348 | 7/1965 | Snurr | 188/67 |
| 3,203,513 | 8/1965 | Allen | 188/67 |
| 3,554,094 | 6/1971 | Gross | 92/28 |
| 4,419,924 | 12/1983 | Peter et al. | 92/27 |
| 4,469,210 | 10/1984 | Rastetter et al. | 188/67 |
| 4,481,974 | 11/1984 | Schmitt et al. | 137/514 |

*Primary Examiner*—Edward K. Look

*Attorney, Agent, or Firm*—Armstrong, Nikaido, Marmelstein & Kubovcik

[57] ABSTRACT

Herein disclosed is a cylinder locking device for locking and stopping the piston rod of a hydraulic cylinder in a desired position. There are fitted rotatably in a housing, a pair of thick, semicylindrical halves which are formed by dividing a thick cylinder having eccentric outer and inner circumferential portions axially into two halves at the thickest and thinnest portions. The piston rod of the hydraulic cylinder is inserted slidably into the inner circumferential portions of the two semicylindrical halves. The piston rod is locked in the desired position by turning the two semicylindrical halves in the opposite directions through a pair of leaves which are attached to the two halves.

6 Claims, 2 Drawing Sheets

CYLINDER LOCKING DEVICE

This application is a continuation-in-part of application Ser. No. 710,245 filed Mar. 11, 1985, now abandoned.

BACKGROUND OF THE INVENTION

1. Field of the Invention

The present invention relates to a cylinder locking device for locking the piston rod of a hydraulic cylinder to stop it in a desired position and, more particularly, to a cylinder locking device which can ensure the locking operation of the piston rod with neither deformation nor wear of the piston rod.

2. Description of the Prior Art

In the prior art, a collet chuck or a hydraulic locking device has been used as the cylinder locking device for locking and stopping the piston rod of hydraulic cylinder. However, either of these has defects such as having a short lifetime and having a structure that is so complicated that production cost is high.

Thus, there has been proposed a cylinder locking device which has a relatively simple structure, as shown in FIGS. 1 and 2. This device is constructed such that a cylindrical housing 2 is fixed eccentrically to a piston rod 3 on the front end portion of a cylinder body 1. A brake disk 4 is fitted rotatably in the housing 2. The piston rod 3 is inserted into an eccentric hole which is formed axially in the brake disk 4. A lever 6 is fixed to an outer circumferential portion of the brake disk 4 and protrudes out through an opening 5 which is formed in a portion of the housing 2. When the lever 6 is pushed down in the direction of the arrow in FIG. 2 to slightly turn the brake disk 4, the brake disk 4 pushes and locks the piston rod 3. At this time, as shown in FIG. 1, the pushing force F caused by the slight turn of the brake disk 4 is applied upward to the lower portion of the piston rod 3 so that it is received only by the upper portions of bearing metals 7 and so that the turning force by the lever 6 is applied to the piston rod 3. As a result, the piston rod 3 is subjected, when it is to be locked, to both shearing forces by the pushing force F and drags $F_1$ and $F_2$ generated at the bearing metals 7 and a torsion by the turn. A problem arises because the piston rod 3 and the bearing metals 7 become worn and deformed.

SUMMARY OF THE INVENTION

A cylinder locking device according to the present invention is constructed such that two thick, semicylindrical halves are forced by dividing a thick cylinder having eccentric outer and inner circumferential portions axially into two halves at its thickest and thinnest portions, such that the piston rod of a hydraulic cylinder is inserted slidably in the inner circumferential portions of the two semicylindrical halves, and such that the two semicylindrical halves are fitted rotatably in a housing, whereby the piston rod is locked by turning the two semicylindrical halves in opposite directions, respectively, with levers which are protruded from the two halves.

As a result, the piston rod can be locked reliably with neither deformation nor wear of the piston rod and bearings while simplifying the structure of the locking device.

DESCRIPTION OF THE PREFERRED EMBODIMENTS

Figure 2:
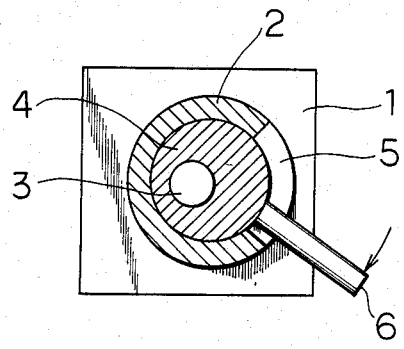
FIG. 2 is a section talen along line I—I of FIG. 1.
Figure 1:
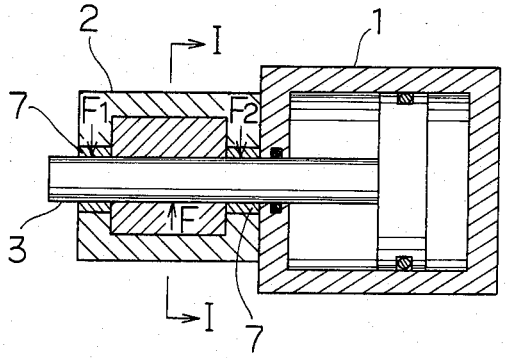
FIG. 1 is a sectional view showing the cylinder locking device of the prior art.
Figure 4:
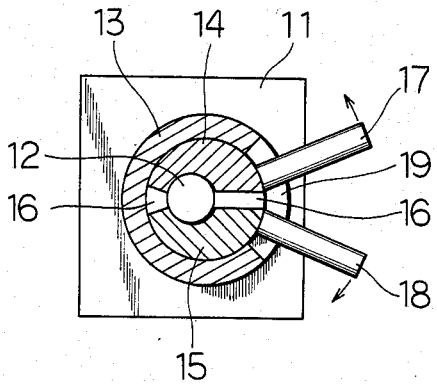
FIG. 4 is a section taken along line II—II of FIG. 3.
Figure 3:
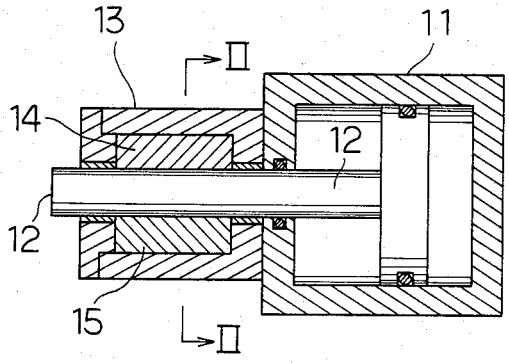
FIG. 3 is a sectional view showing an embodiment of the present invention.
Figure 5:
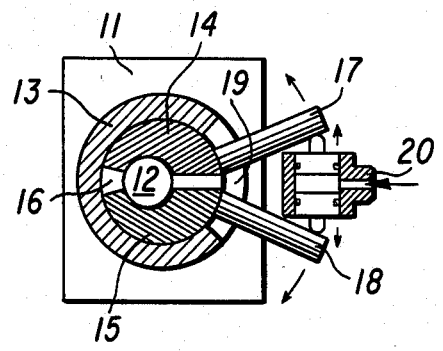
FIG. 5 is a second embodiment of the present invention.

FIG. 3 is an axial section showing a hydraulic cylinder 11 which is equipped with a cylinder locking device, and FIG. 4 is a section taken along line II—II of FIG. 3. A piston rod 12 is protruded from the front face portion of the hydraulic cylinder 11, on which is also fixed a cylindrical housing 13 of the cylinder locking device. The piston rod 12 is inserted eccentrically into the housing 13. In this housing 13, there are also fitted two semicylindrical halves 14 and 15 which form together a pair of brake shoes or locking elements. These two semicylindrical halves 14 and 15 are formed by dividing a thick cylinder having eccentric outer and inner circumferential portions axially into two halves at the thickest and thinnest portions. Moveover, the piston rod 12 is inserted eccentrically in the semicylindrical halves. 14 and 15, and these halves 14 and 15 have their mating faces slightly cut. away so as to turn to some extend and to form a space 16 inbetween. With the semicylindrical halves 14 and 15 being fitted in the housing 13, the piston rod 12 is allowed to slide therein. To the semicylindrical halves 14 and 15, moreover, there are respective connected locking levers 17 and 18, which are protruded out through a cut-away portion 19 formed in a portion of the housing 13. A hydraulic or electromagnetic actuator 20 may be used to actuate the levers 17 and 18 in the directions of arrows (shown in FIG. 5).

Next, the operations of the cylinder locking device thus constructed will be described in the following. First of all, as shown in FIG. 4, the piston rod 12 is no locked but is allowed to slide freely in the state in which the two semicylindrical halves 14 and 15 take the same positional relationship as that taken when the cylinder is divided into the two halves and in which the imaginary dividing line is contained in a horizontal plane extending through the center line of the piston rod 12.

When the piston rod 12 is to be locked and stopped, on the other hand, the levers 17 and 18 are turned apart from each other in the directions of the arrows of FIG. 4. Then, the upper semicylindrical half 14 pushes the piston rod 12 down whereas the lower half 15 pushes the piston rod 12 up, because the two semicylindrical halves 14 and 15 have their centers of rotations eccentric to the center line of the piston rod 12. When the halves of the locking elements are moved in opposite directions, the piston rod is pinched between the semicircular locking portions without materially displacing the piston rod centerline in the locked position from the centerline in the unlocked position. As a result, the piston rod 12 is clamped and locked by the semicylindrical halves 14 and 15, and these locked states are held by the frictional resistances among the inner circumferences of the housing 13, the inner and outer circumferences of the semicylindrical halves 14 and 15, and the outer circumferences of the piston rod 12. Moreover, the locking operations by the levers 17 and 18 can be effected with the relatively weak force due to the "principle of a lever". Since the piston rod 12 is clamped by the two semicylindrical halves 14 and 15, still moreover, it can be locked ideally without being subjected to the shearing force and the turning force, i.e. the locking force is applied without imposing additional braking forces to the bearings at either end of the locking device. Further, the locking elements need to move only a short distance to go from the locking position to an unlocking position and there is not movement of the locking elements in the longitudinal direction of the piston rod.

Figure 6:
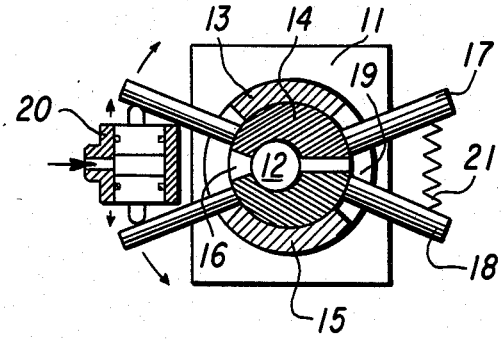
FIG. 6 is a third embodiment of the present invention.

According to another embodiment of the present invention, shown in FIG. 6, there is sandwiched between the levers 17 and 18 a compression coil spring 21 which is provided for biasing the levers 17 and 18 in the arrow directions (i.e., in the locking directions) at all times, and there is also provided a hydraulic or electromagnetic actuator 20 for moving the levers 17 and 18 or the semicylindrical halves 14 and 15 in the unlocking directions against the biasing force of that compression coil spring. While the locking device is in its inoperative state, the piston rod 12 is automatically locked at all times by the biasing force of the compression coil spring to afford a failsafe function.

As has been described hereinbefore, according to the present invention, the cylinder locking device is constructed such that the piston rod is clamped and locked by the two semicylindrical halves. As a result, the cylinder locking device of the present invention can have its structure made simpler and smaller than that f the conventional device. At the same time, the piston rod can be locked without being subjected to an shearing force and any turning force so that it can be reliably stopped while preventing itself and the bearing portions from being deformed and worn.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A cylinder locking device comprising:

(a) a housing, having a bore, through which passes a piston rod, said piston rod being parallel to an axis of said bore but being displaced from a centerline of said bore;

(b) a pair of locking elements, each having an outer curved surface with a radius corresponding to a radius of said bore of said housing and each having an inner semicircular groove with a radius corresponding to a radius of said piston rod, said groove being displaced from a centerline of said locking elements so as to partially encircle said piston rod parallel to its axis, said locking elements each having a center of rotation eccentric to the centerline of said piston rod, each of said locking elements being relieved on either side of said semicircular groove by first and second facing margins so as not to be in contact with each other on both sides of said semicircular groove when disposed between said housing and said piston rod;

(c) a pair of levers, one lever being attached to each locking element and protruding from said housing;

wherein rotational movement of said levers in opposite directions causes each said locking elements to eccentrically rotate in opposite directions to bindingly engage said piston rod and lock said piston rod into place.

2. A cylinder locking device according to claim 1, further comprising an actuator for moving said levers in a direction causing said locking elements to engage and to lock said piston rod.

3. A cylinder locking device according to claim 1, further comprising:

a coil spring for biasing said levers in a direction causing said locking elements to lock said piston rod; and an actuator means provided for said levers to turn said locking elements in an unlocking direction against said biasing force of said coil spring.

4. A cylinder locking device according to claim 1, further comprising a second pair of levers, two levers are attached to each locking element and further comprising a coil spring for biasing said pair of levers in a direction causing said locking elements to lock said piston rod and an actuator provide between said second pair of levers to turn said locking elements in an unlocking direction against said biasing force of said coil spring.

5. A cylinder locking device comprising:

a piston rod;

a housing having a bore, said piston rod passing through said bore and being parallel to an axis of said bore, said piston rod being displaced from a centerline of said bore, a pair of locking elements, each having an outer curved surface with a radius corresponding to a radius of said bore of said housing, each locking element having an inner semicircular groove with a radius corresponding to a radius of said piston rod, said groove being displaced from a centerline of said locking elements so as to partially encircle said piston rod parallel to said piston rod axis, said locking elements each having a center of rotation eccentric to the centerline of said piston rod, each of said locking elements being relieved on either side of said semicircular groove by first and second facing margins so as not be in contact with each other on both sides of said semicircular groove when disposed between said housing and said piston rod;

a pair of levers, one lever being attached to each locking element and protruding from said housing;

a coil spring for biasing said levers in a direction causing said locking elements to lock said piston rod; and an actuator means provided for said levers to turn said locking elements in an unlocking direction against said biasing force of said coil spring, wherein rotational movement of said levers in opposite directions causes each said locking elements to eccentrically rotate in opposite directions to bindingly engage said piston rod and lock said piston rod into place.

6. A cylinder locking device comprising:

a housing having a bore;

a piston rod passing through said bore, said piston rod being parallel to an axis of said bore but being displaced from a centerline of said bore;

a pair of locking elements, each having an outer curved surface with a radius corresponding to a radius of said bore of said housing, each locking element having an inner semicircular groove with a radius corresponding to a radius of said piston rod, said groove being displaced from a centerline of said locking elements so as to partially encircle said piston rod parallel to said piston rod axis, said locking elements each having a center of rotation eccentric to the centerline of said piston rod, each of said locking elements being relieved on either side of said semicircular groove by first and second facing margins so as not be in contact with each other on both sides of said semicircular grove when disposed between said housing and said piston rod;

first and second pair of levers, two levers being attached to each locking element and protruding from said housing;

a coil spring for biasing said first pair of levers in a direction causing said locking elements to lock said piston rod; and an actuator provided between said second pair of levers to turn said locking elements in an unlocking direction against a biasing force of said coil spring, wherein rotational movement of said levers in opposite directions causes each said locking elements to eccentrically rotate in opposite directions to bindingly engage said piston rod and lock said piston rod into place.

* * * * *